US005542778A

United States Patent [19]

Mallon

[11] Patent Number: 5,542,778

[45] Date of Patent: Aug. 6, 1996

[54] C-CHANNEL DEVICE FOR MEDIAN BARRIERS AND METHOD FOR PROTECTING ELECTRICAL WIRES ALONG MEDIAN BARRIERS

[75] Inventor: Richard Mallon, Reno, Nev.

[73] Assignee: Carsonite International Corporation, Early Branch, S.C.

[21] Appl. No.: 369,928

[22] Filed: Jan. 9, 1995

[51] Int. Cl.[6] ..... E01F 13/00

[52] U.S. Cl. ..... 404/6; 404/9

[58] Field of Search ..... 404/6, 9, 11, 14; 256/1, 13.1; 403/387

[56] References Cited

FOREIGN PATENT DOCUMENTS 2698893 7/1994 France ..... 404/9

*Primary Examiner*—Michael Powell Buiz
*Assistant Examiner*—Pamela A. O'Connor
*Attorney, Agent, or Firm*—Thorpe, North & Western

[57] ABSTRACT

A channel structure for housing electrical wires and supporting glarefoil blades along a median barrier of a divided highway or other roadway. An elongate composite channel structure defines an interior channel and a flat exterior top support surface. The composite channel is attachable to the top of a median barrier to cover electrical streetlamp wiring extending along the top of the barrier. A series of glarefoil blades are attachable directly and individually to the flat top support surface so that the support surface is the only object which provides structural, stabilizing support for each of the glarefoil blades.

9 Claims, 1 Drawing Sheet

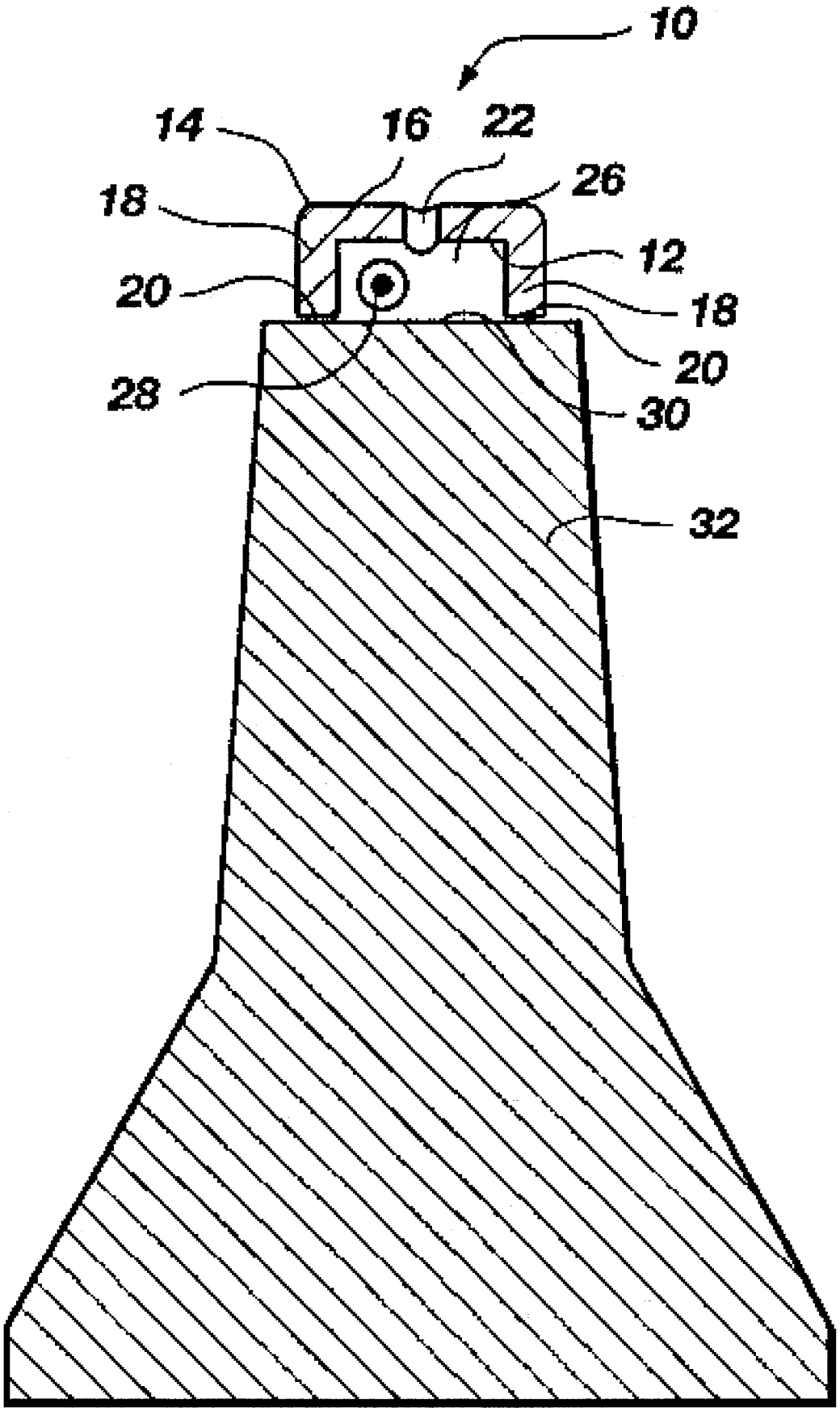
10
14
16
22
26
18
12
20
18
20
28
30
32

C-CHANNEL DEVICE FOR MEDIAN BARRIERS AND METHOD FOR PROTECTING ELECTRICAL WIRES ALONG MEDIAN BARRIERS

BACKGROUND OF INVENTION

1. The Field of the Invention

The present invention relates generally to assemblies for channeling streetlight wiring and supporting glarefoil blades, and more particularly to a composite C-shaped channel structure.

2. The Background Art

Glare screens, glarefoils and the like have found widespread acceptance in the road construction industry for reducing the headlight glare associated with two-way traffic. Glarefoils are typically mounted on the top of median highway barriers, such as the well known New Jersey barrier. Glarefoils and glare screens are light-deflecting bodies spaced and angled so as to deflect headlight glare produced by vehicles traveling in an opposing traffic lane.

Electric street lamps are also widely used in conjunction with median barriers and are often mounted directly on or beside the barrier. Electrical wiring to power the lamps is extended along the median barrier. The limited amount of space available on and around the median barriers has prompted creative solutions to the need to house and protect the electrical wiring and to provide stabile structural support for the glare screens and glarefoils.

Glarefoil blades are typically secured to a common steel support plate which is then secured to the top of the median barrier. When street lamps are involved, it is known to lay the electrical street lamp wiring along the top of the median barrier and cover it with a sturdy steel casing to house and protect the wiring. The support plate carrying the glarefoil blades is attached on top of the metal casing to economize the limited amount of available space.

The prior art methods for supporting the glarefoils and housing the electrical street lamp wiring are characterized by a number of disadvantages. Light duty cranes are required on the job site to place and set the steel casing, because it is so heavy. The steel protective casing has the potential to penetrate a vehicle or person if dislodged in an accident, because of its weight and stiffness. An accident or a loose electrical connection could cause the steel casing to operate as a dangerous conductor, thereby increasing the liability of the contractor and the associated Department of Transportation in the event of an electrical shock. Further, the steps involved in installing both the steel casing and the glarefoil support plate render the installation process laborious and time consuming. Of current interest is a protective support structure for glarefoils and street lamp wiring which is simple in design and easy to install accurately.

OBJECTS AND SUMMARY OF THE INVENTION

It is therefore an object of the present invention to provide a channel structure for simultaneously supporting traffic safety devices and housing electrical street lamp wiring.

It is another object of the invention to provide such a channel structure which utilizes fewer separate pieces.

It is an additional object of the invention to provide such a channel structure which does not conduct electricity.

It is a further object of the invention to provide such a channel structure which minimizes risks of penetrating vehicles and people in the event of accidental dislodgement.

It is yet another object of the invention to provide such a channel structure which is lighter and easier to install.

The above objects and others not specifically recited are realized in a specific illustrative embodiment of a channel structure for housing electrical wires and supporting glarefoil blades along a median barrier of a divided highway or other roadway. An elongate composite channel structure defines an interior channel and a flat exterior top support surface. The composite channel is attachable to the top of a median barrier to cover electrical streetlamp wiring extending along the top of the barrier. A series of glarefoil blades are attachable directly and individually to the flat top support surface so that the support surface is the only object which provides structural, stabilizing support for each of the glarefoil blades.

Additional objects and advantages of the invention will be set forth in the description which follows, and in part will be apparent from the description, or may be learned by the practice of the invention. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which:

FIG. 1 is a side, cross sectional view of a channel structure mounted upon a median barrier in accordance with the principles of the present invention; and FIG. 2 is a perspective view of the channel structure of FIG. 1.

DETAILED DESCRIPTION

A preferred embodiment in accordance with the present invention is illustrated in FIGS. 1–2 wherein is shown a channel structure, generally designated at 10. The channel structure 10 preferably comprises an elongate composite channel having a C-shaped cross section so as to define an interior channel 12 and an elongate exterior support surface 14. The support surface 14 is preferably planer and located opposite the interior channel 12 as shown. The phrase "C-shaped" as applied to the channel structure 10 refers broadly to the aspect of a main wall 16 with two opposing side walls 18 extending therefrom and terminating in distal edges 20, and thus does not require a formal rounded shape of a "C" but can be U-shaped, square, semi-circular and so forth.

The channel structure 10 is configured to be affixed to a top surface 30 of a median barrier 32 by any suitable attachment means. The channel structure 10 is positioned with the interior channel 12 facing and extending along the median barrier 32 such that the distal edges 20 rest against the barrier in a seated position, preferably along the top surface 30. The interior channel 12 thereby defines an elongate enclosure 26 for housing one or more electrical wires 28 such as those used to supply power to street lamps 29 (FIG. 2). The side walls 18 are of a height sufficient to enable the streetlight cables 28 to reside within the enclosure 26 between the barrier 32 and the main wall 16 of the channel structure 10. Accordingly, the side walls 18 are preferably at least 0.5 inches high.

The street lamps 29 are preferably installed in intermediate notches 31 formed in the median barrier 32. The attachment means can include bolt holes 22 formed in the main wall 16 of the channel structure 10 to permit bolts 24 (FIG. 2) to be inserted therethrough for anchoring to the median barrier 32. The main wall 16 itself may thus also be considered as the attachment means.

The invention includes means for attaching a plurality of traffic safety devices, such as glarefoil assemblies to the exterior support surface 14 of the channel structure 10. For example, each glarefoil assembly may include a glarefoil blade 40 and a flat-based L-shaped connector 42 as in FIG. 2 (or some other suitable connecting means). The flat-based L-shaped connector 42 can be used to screw one side thereof to a glarefoil blade 40 and the remaining side to the support surface 14 as shown in FIG. 2. As such, each glarefoil blade assembly (including blade 40 and connector 42) is individually secured directly to the exterior support surface 14 such that the exterior support surface is the only object which provides structural, stabilizing support for each of the glarefoil assemblies. Any suitable means for attaching the glarefoil assemblies 40 to the exterior support surface 14 may be used. The glarefoil blades 40 are adapted to reduce the headlight glare associated with two-way traffic, such as the glarefoil assembly described and claimed in U.S. Pat. No. 5,190,394 (issued on Mar. 2, 1993 to Richard D. Mallon and Michael M. Leigh).

It will be appreciated that the channel structure 10 can be used to support any traffic safety device instead of the glarefoil blades 40. The composite channel structure 10 is much lighter and not as stiff as the prior art steel casings, and thereby significantly minimizes the risk of penetrating vehicles and people in the event of an accident which dislodges the channel from the median barrier. Composite material is not electrically conductive, so the composite channel structure 10 does not pose the electrical danger as does the prior art steel casing. Thus, the liability of the contractor and the associated Department of Transportation is reduced in the event of inadvertent contact between live electrical wires 28 and the channel structure 10. The composite channel structure 10 preferably comprises fiber matting secured within a thermosetting resin, formed by conventional pultrusion processes.

Another significant advantage of the present invention is the elimination of the prior art base support plate for attaching the glarefoil blades to the casing. The conventional method thus requires the glarefoil blades to be attached to a base plate, then the base plate must be attached to the metal casing, and the casing is then installed onto the median barrier. Applicant's invention enables the glarefoil assemblies (including blades 40 and connectors 42) to be attached directly to the channel structure 10, which can be done prior to transportation to the job site. Therefore, the only step required on the job site is to install the channel structure 10 to the median barrier 32. The time and effort required during the installation procedure is significantly and advantageously reduced by the present invention.

A presently preferred method for protecting electrical streetlight wires along a median barrier of a divided roadway and for reducing headlight glare includes the steps of:

(a) attaching elongate composite channel means having a C-shaped cross section including first and second opposing side walls to a top surface of a median barrier along a divided roadway such that the side walls are seated against said top surface of the barrier, wherein said channel means defines an interior channel facing and extending along the top of the median barrier and an opposing, substantially planer top support surface, and positioning the channel means such that the interior channel encloses streetlight wires extending along the top of the median barrier;

(b) securing a plurality of glarefoil assemblies to the top support surface of the channel means such that said top support surface is the only object to which each of the glarefoil assemblies is attached, said glarefoil assemblies being adapted to reduce headlight glare from oncoming traffic along the divided roadway.

It will be appreciated that various modifications and alternative configurations of the composite channel structure 10 can be made in accordance with the principles of the present invention. Such changes may from time to time be made by those skilled in the relevant arts without departing from the spirit and scope of the invention as defined by the appended claims. Those skilled in the art will appreciate that the scope of the present invention encompasses many combinations and a broad spectrum of features and structures equivalent to those specifically discussed herein. The principles of the invention may thus be used in any setting requiring the advantages thereof. Those having ordinary skill in the field of this invention will appreciate the advantages of the invention and its application to a wide variety of uses, and that objectives stated above are advantageously achieved by the present invention.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A channel structure for housing electrical wires and supporting traffic safety devices along a median barrier of a divided roadway comprising:

elongate composite channel means for housing electrical streetlight cable therein, said channel means including a composite main wall and first and second composite opposing side walls disposed along the main wall and extending outward therefrom such that the main wall and the side walls collectively form a unitary, composite three-sided channel member, said channel member being configured for attachment to a median barrier of a divided roadway with the side walls being seated against the barrier such that the barrier and the three-sided channel member collectively define an elongate enclosure and wherein the side walls are of a height sufficient to enable electrical streetlight cable to reside within the elongate enclosure between the barrier and the main wall of the channel means, the main wall having an exposed, exterior surface; and a plurality of traffic safety devices attached to the exterior surface of the main wall of the channel means and extending outwardly therefrom without extending into the elongate enclosure to thereby avoid interfering contact between the safety devices and the electrical streetlight cable when the channel member is attached to the median barrier.

2. A channel structure as defined in claim 1, wherein the height of the side walls is at least 0.5 inches to thereby enable heavy-duty electrical conduit to reside within the elongate enclosure between the barrier and the main wall of the channel means.

3. A channel structure as defined in claim 1, wherein the side walls of the channel means are configured for resting upon a top surface of the median barrier in a seated position when the channel means is attached to the median barrier, such that when the channel means resides in the seated position the exterior surface of the central wall comprises a top surface of the channel means for supporting thereon the traffic safety devices which comprise a series of glarefoil blade assemblies adapted to reduce headlight glare from oncoming traffic along the divided roadway.

4. A channel structure as defined in claim 3, wherein the exterior support surface comprises a substantially flat elongate surface for supporting flat base assemblies of the glarefoil blades.

5. A channel structure as defined in claim 1, wherein the composite channel means comprises fiber matting secured within a thermosetting resin matrix.

6. A combination glarefoil and housing assembly for protecting electrical streetlight wires along a median barrier of a divided roadway and for reducing headlight glare, said assembly comprising:

an elongate composite channel having a C-shaped cross section so as to define an interior channel and an opposing, substantially planer exterior support surface;

means for attaching the channel to a top surface of a median barrier along a divided roadway such that the interior channel faces and extends along the top of the median barrier to thereby define an elongate enclosure for housing electrical streetlight wires therein, such that the exterior support surface comprises a flat top surface of the channel, wherein the interior channel has a height sufficient to enable electrical streetlight cable to reside within the elongate enclosure between the barrier and the support surface of the channel;

a plurality of glarefoil assemblies adapted to reduce headlight glare from oncoming traffic along the divided roadway, each glarefoil assembly being secured upon the support surface of the channel and extending outwardly therefrom without extending into the elongate enclosure to thereby avoid interfering contact between the safety devices and the electrical streetlight cable when the channel member is attached to the median barrier.

7. A combination glarefoil and housing assembly as defined in claim 6, wherein the composite channel comprises fiber matting secured within a thermosetting resin matrix.

8. A method for protecting electrical streetlight wires along a median barrier of a divided roadway and for reducing headlight glare, said method comprising:

(a) attaching elongate composite channel means having a C-shaped cross section including first and second opposing side walls to a top surface of a median barrier along a divided roadway such that the side walls are seated against said top surface of the barrier, wherein said channel means defines an interior channel facing and extending along the top of the median barrier and an opposing, substantially planer top support surface, and positioning the channel means such that the interior channel encloses streetlight wires extending along the top of the median barrier;

(b) securing a plurality of glarefoil assemblies to the top support surface of the channel means without causing said glarefoil assemblies to extend into the elongate enclosure to thereby avoid interfering contact between the safety devices and the electrical streetlight wires when the channel member is attached to the median barrier, said glarefoil assemblies being adapted to reduce headlight glare from oncoming traffic along the divided roadway.

9. A method as defined in claim 8, wherein step (a) further comprises forming the composite channel means as a fiber matting secured within a thermosetting resin matrix.

* * * * *